US008356868B2

(12) United States Patent
Miyata

(10) Patent No.: US 8,356,868 B2
(45) Date of Patent: Jan. 22, 2013

(54) IMAGE FORMING APPARATUS FOR ESTABLISHING PRINT GAP BY RESTRICTING ROTATION OF ECCENTRIC BEARING

(75) Inventor: Tsuyoshi Miyata, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 332 days.

(21) Appl. No.: 12/702,027

(22) Filed: Feb. 8, 2010

(65) Prior Publication Data

US 2010/0201743 A1 Aug. 12, 2010

(30) Foreign Application Priority Data

Feb. 9, 2009 (JP) ..... 2009-027796

(51) Int. Cl.
*B41J 25/308* (2006.01)
*B41J 11/20* (2006.01)

(52) U.S. Cl. ..... 347/8; 400/55

(58) Field of Classification Search ..... 347/8
See application file for complete search history.

(56) References Cited

U.S. PATENT DOCUMENTS

| | | | | |
|---|---|---|---|---|
| 5,887,987 | A * | 3/1999 | Sawano | 347/8 |
| 2004/0041860 | A1* | 3/2004 | Takahashi et al. | 347/8 |
| 2005/0253880 | A1* | 11/2005 | Nakamura et al. | 347/8 |

FOREIGN PATENT DOCUMENTS

| | | | |
|---|---|---|---|
| JP | 8-258369 | | 10/1996 |
| JP | 8-300769 | | 11/1996 |
| JP | 9-99603 | | 4/1997 |
| JP | 9-220841 | | 8/1997 |
| JP | 2005325757 | A * | 11/2005 |
| JP | 2007-223210 | | 9/2007 |
| JP | 2007-223232 | | 9/2007 |

OTHER PUBLICATIONS

Machine generated English translation of JP 2007-223232 A to Tachibana, "Image Forming Apparatus," generated via http://www19.ipdl.inpit.go.jp/PA1/cgi-bin/PA1DETAIL on Apr. 25, 2012; 8pp.*

* cited by examiner

*Primary Examiner* — Shelby Fidler
(74) *Attorney, Agent, or Firm* — Cooper & Dunham LLP

(57) ABSTRACT

An image forming apparatus includes a printhead, a carriage, one or more guide members, and a positioning mechanism. The printhead is mounted on the carriage. The one or more guide members support the carriage. The positioning mechanism includes an eccentric bearing and a rotation restrictor. The eccentric bearing is connected to each guide member and rotatable around a rotational axis offset from a guide member longitudinal axis to move the guide member relative to a substantially horizontal plane. The rotation restrictor defines a first point of contact with the eccentric bearing when the carriage is in a first operational position, and a second point of contact with the eccentric bearing when the carriage is in a second operational position. At least one of the first and second points of contact is displaceable with respect to the bearing rotational axis to modify the corresponding operational position of the carriage.

7 Claims, 5 Drawing Sheets

IMAGE FORMING APPARATUS FOR ESTABLISHING PRINT GAP BY RESTRICTING ROTATION OF ECCENTRIC BEARING

CROSS-REFERENCE TO RELATED APPLICATIONS

The present patent application claims priority pursuant to 35 U.S.C. §119 from Japanese Patent Application No. 2009-027796, filed on Feb. 9, 2009, which is hereby incorporated by reference herein in its entirety.

BACKGROUND OF THE INVENTION

1. Field of the Invention

The present invention relates to an image forming apparatus, and more particularly, to an image forming apparatus that forms an image by employing an inkjet printhead mounted on a carriage, which incorporates a positioning mechanism for positioning the printhead carriage to adjust a gap defined between the printhead and a plane supporting a recording medium during printing.

2. Discussion of the Background

Inkjet printing technologies are employed in various image forming apparatuses, such as printers, facsimiles, photocopiers, plotters, and multifunctional machines incorporating several of those imaging capabilities.

An inkjet printer forms an image by employing a fluid-ejecting device called a printhead having one or more nozzles provided in a nozzle face to eject ink in droplets onto a recording medium such as a sheet of paper. The printhead is typically mounted on a carriage supported on one or more guide members extending along a scanning axis, with the nozzle face directed toward a generally planar, horizontal plane on which a recording medium is placed during printing.

To date, mainly two types of inkjet printers are available, depending on the configuration of printhead employed: a serial inkjet printer with a relatively narrow movable printhead, and a line inkjet printer with a relatively wide stationary printhead. The former prints an image by reciprocally moving the printhead back and forth along the scanning axis to traverse the width of a recording sheet, whereas the latter operates by advancing the recording sheet past the printhead without reciprocating the printhead, which spans the entire width of the recording sheet.

What is important for good performance of an inkjet printer is to establish an adequate distance or "print gap" between the printhead and the plane supporting a recording sheet during printing, or more precisely, to maintain a constant distance between the printhead nozzle face and the surface of a recording sheet placed on the sheet supporting plane. In general, too narrow a print gap causes the nozzle face to interfere with the recording sheet, resulting in ink smearing or blotting the recording sheet and/or causing frequent sheet jams, and too large a print gap reduces the accuracy with which the printhead deposits ink at desired locations on the recording sheet, leading to concomitant image defects, such as misregistration and color inconsistencies, appearing on a resulting image.

To obtain a desired print gap, a printhead assembly is typically provided with a positioning mechanism that enables positioning of the printhead carriage by moving it relative to the sheet supporting plane. For example, one such mechanism uses a pair of eccentric bearings mounted to opposite ends of an elongated guide member supporting a printhead carriage over a sheet supporting plane, which are rotatable around a rotational axis offset from a longitudinal axis of the guide member. When rotated, these eccentric bearings cause the guide member to move perpendicular to its longitudinal axis together with the carriage supported thereon. The positioning mechanism is provided with an operating lever that enables an operator to adjust the print gap by raising or lowering the carriage relative to the sheet supporting plane.

Such print gap adjustment is particularly important where an inkjet printer handles various types of recording sheets from one operation to another. This is because an appropriate print gap depends on the type of recording sheet in use, which has a specific thickness to define a spacing between the nozzle face and the sheet surface during printing. In other words, to maintain a constant space between the nozzle face and the sheet surface, wider print gaps are needed when thicker recording sheets are used, and narrower print gaps are needed when thinner recording sheets are used. Thus, a positioning mechanism is required to accommodate variations in the print gap depending on the thickness of recording sheet.

A straightforward approach to meeting this requirement is to vary the carriage position and the print gap steplessly depending on the recording sheet thickness. Although desirable for accurate spacing between the nozzle face and the sheet surface, such a configuration would complicate the positioning mechanism, making it expensive to manufacture and difficult to handle.

A more practical approach is to provide only two levels of print gaps or operational positions to which the positioning mechanism can position a printhead carriage, one for relatively thick sheets and the other for relatively thin sheets. This approach is simple and ready to implement compared to steplessly varying the print gap, and works well where an inkjet printer normally handles recording sheets of only two standard thicknesses. For such reasons, the two-level positioning arrangement is employed in several printhead positioning mechanisms.

However, this conventional method has certain drawbacks. One drawback is that the two-level positioning, by its nature, cannot provide an appropriate print gap for any specific recording sheet that has a thickness other than those of standard thick and thin recording sheets. Moreover, the simple two-level positioning fails to accommodate variations in the print gap caused by environmental factors other than sheet thickness, for example, deformation or displacement of a transport belt defining a surface on which a recording sheet is placed during printing.

Another drawback of the conventional method is the difficulty in initially setting up two levels of print gap with both precise parallelism and adequate spacing between the nozzle face and the sheet supporting plane. This difficulty is a problem not just with the two-level positioning but with all the positioning mechanisms that need initial setup of the print gap. Typically, initial adjustment for a print gap is a complicated process requiring some special tools to complete, resulting in considerable time required during assembly of a printhead carriage.

Hence, what is needed is a simple mechanism for positioning a printhead carriage in an image forming apparatus that provides ready adjustment of a print gap to accommodate both various types of recording sheets and environmental factors causing variations in the print gap, while requiring no complicated process to establish an appropriate print gap during assembly of the printhead carriage.

SUMMARY OF THE INVENTION

Exemplary aspects of the present invention are put forward in view of the above-described circumstances, and provide a novel image forming apparatus that forms an image by employing an inkjet printhead mounted on a carriage.

In one exemplary embodiment, the novel image forming apparatus includes a printhead, a carriage, one or more guide members, and a positioning mechanism. The printhead prints an image on a recording medium placed on a substantially horizontal supporting plane. The printhead is mounted on the carriage. Each of the one or more guide members extends along a longitudinal axis substantially parallel to the horizontal plane to support the carriage with the printhead substantially parallel to the supporting plane. The positioning mechanism enables positioning of the carriage relative to the supporting plane, and includes an eccentric bearing and a rotation restrictor. The eccentric bearing is connected to each guide member and rotatable around a rotational axis offset from the guide member longitudinal axis to move the guide member relative to the supporting plane. The rotation restrictor restricts rotation of the eccentric bearing. The rotation restrictor defines a first point of contact with the eccentric bearing when the carriage is in a first operational position relatively close to the supporting plane. The rotation restrictor defines a second point of contact with the eccentric bearing when the carriage is in a second operational position relatively far from the supporting plane. At least one of the first and second points of contact is displaceable with respect to the bearing rotational axis to modify the corresponding operational position of the carriage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
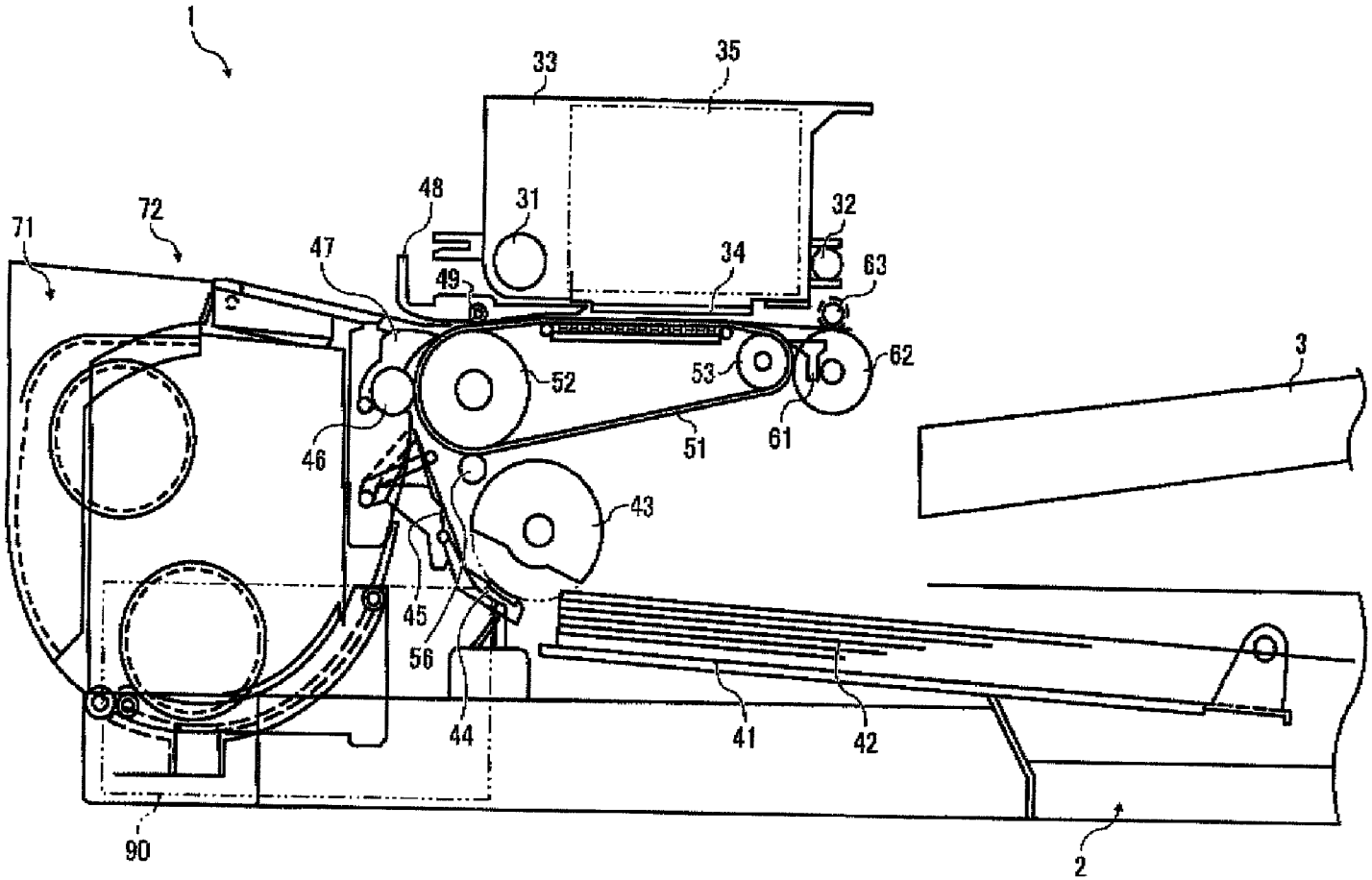
FIG. 1 is a side view schematically illustrating an image forming apparatus according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In the following discussion, the term "image" includes any visual representation of an object, including text, graphics, pictures, design, and artwork, either concrete or abstract, and the terms "image formation", "imaging", and "printing" refer to production of images on recording media, including, but not limited to, thread, yarn, leather, metal, plastic, glass, wood, ceramic, etc., and more particularly, on those materials in the form of webs or sheets, such as, most typically, paper, transparency films, and textiles. The term "image forming apparatus" used herein refers to any system capable of producing images as set forth herein, particularly to those that perform image formation by ejecting droplets of ink onto recording media. The term "ink" is not limited to conventional inks but includes any material that forms liquid droplets when ejected into air, such as deoxyribonucleic acid (DNA) samples for genome analysis, photoresist for photolithography or patterning, etc.

Referring now to the drawings, wherein like reference numerals designate identical or corresponding parts throughout the several views, examples and exemplary embodiments of this disclosure are described.

Figure 2:
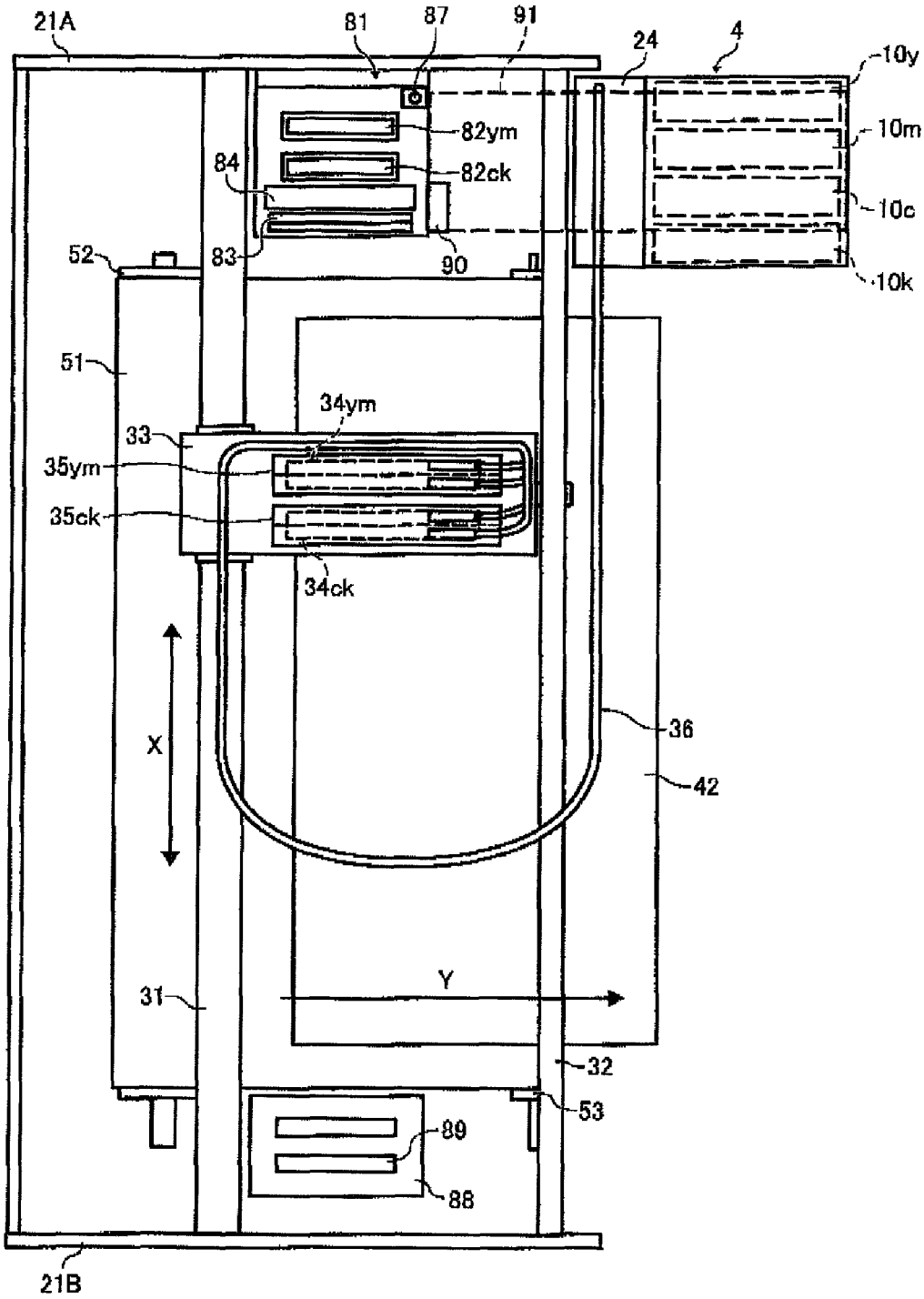
FIG. 2 is a top plan view schematically illustrating the image forming apparatus of FIG. 1.

FIGS. 1 and 2 are side and top plan views, respectively, schematically illustrating an image forming apparatus 1 according to this patent specification.

As shown in FIGS. 1 and 2, the image forming apparatus 1 is configured as a serial inkjet printer employing printhead modules 34*ym* and 34*ck* (collectively referred to as a printhead 34) combined with multiple ink containers 35*ym* and 35*ck*, mounted on a printhead carriage 33 disposed atop the apparatus body. The carriage 33 is supported above a transport belt 51 by a pair of parallel first and second guide rods 31 and 32 extending between opposed, first and second sidewalls 21A and 21B of the apparatus body. While not depicted in FIGS. 1 and 2, the carriage 33 is connected to a motor or drive mechanism that actuates the carriage 33 to slide reciprocally back and forth in a main scan direction X along the guide rods 31 and 32 as the transport belt 51 moves in a sub-scan direction Y orthogonal to the main scan direction X.

The printhead modules 34*ym* and 34*ck* each defines a pair of nozzle arrays arranged parallel to the sub-scan direction Y at the bottom face of each module for ejecting droplets of ink of particular colors, the former for yellow and magenta inks, and the latter for cyan and black inks. The printhead modules 34*ym* and 34*ck* are in fluid communication with the ink containers 35*ym* and 35*ck*, respectively, which hold ink for immediate supply to the printhead 34 as needed during printing. The ink containers 35 are connected to Ink cartridges or main tanks 10*y*, 10*m*, 10*c*, and 10*k* via a flexible supply tube 36 equipped with a pump 24 for dispensing ink.

The printhead 34 is provided with nozzle caps 82*ym* and 82*ck*, a wiper blade 83, and a first spittoon 84 located beside the first sidewall 21A, as well as a second spittoon 88 with elongated openings 89 therein parallel to the nozzle arrays beside the second sidewall 21B, which together form a maintenance station 81 to clean and maintain the nozzle face. Also, fixed and removable waste ink tanks 90 and 91 are located below the maintenance station 81 to drain and collect ink wasted during operation of the maintenance station 81, the former inaccessible from outside and the latter releasably mounted to the apparatus body.

With particular reference to FIG. 1, the image forming apparatus 1 also includes a sheet tray 2 at the bottom to accommodate a stack of recording media 42, such as sheets of paper, loaded on an upwardly-biased bottom board 41. The sheet tray 2 is provided with a pickup roller 43 and a separator pad 44 formed of high-friction material and pressed against the pickup roller 43 to introduce a recording sheet 42 into a sheet feed path defined by a guide plate 45, a counter roller 46, an edge guide 47, and a roller assembly 48 having a pressure roller 49 embedded therein, for feeding upward to the transport belt 51.

The transport belt 51 is an endless belt looped for rotation around a motor-driven conveyor roller 52 and a tension roller 53 immediately below the printhead carriage 33, with its outer surface held in contact with a charge roller 56. At one side of the transport belt 51 is an output unit formed of a sheet separator 61, an ejection roller 62, and a spur 63, leading to an output tray 3 for holding recording sheets 42 after printing. At the opposite side of the transport belt 51 is a sheet reversing unit 71 releasably mounted on the apparatus body, with a manual feed tray 72 sitting atop to feed a recording sheet 42 from outside the apparatus body.

The image forming apparatus 1 performs printing with the printhead 34 ejecting ink from the nozzle face toward a recording sheet 42 conveyed on the sheet supporting surface or plane defined on the transport belt 51 below the printhead carriage 33.

During operation, first, the pickup roller 43 and the separator pad 44 draw a recording sheet 42 from the sheet tray 2 and advance it upward into the sheet feed path. Entering the sheet feed path, the fed sheet 42 is substantially vertically oriented, and inserted into an entrance nip defined as where the sheet is gripped between the counter roller 46 and the conveyor roller 52, guided along the guide plate 45.

Downstream in the sheet feed path, the transport belt 51 rotates clockwise in the drawing together with the adjoining roller 53 as the conveyor roller 52 rotates clockwise in the drawing to impart motion to the belt transport mechanism. Upon rotation, the transport belt 51 develops positively and negatively charged areas of uniform size alternately appearing along the length of its outer surface. This recurring pattern of electric charges is created by applying an alternating voltage, i.e., a voltage with polarity switching repeatedly between negative and positive over time, to the charge roller 56 held in rotational contact with the transport belt 51.

The recording sheet 42 reaching the entrance nip is attracted to the charged surface of the transport belt 51 with a leading edge thereof guided by the edge guide 47 and pressed against the belt surface by the roller assembly 48. The transport belt 51 rotates to turn the recording sheet 42 substantially 90 degrees and forwards it, substantially flat, to a print zone located immediately below the printhead carriage 33.

In the print zone, the transport belt 51 advances the sheet 42 in a stepped motion in the sub-scan direction Y, while the carriage 33 traverses over the incoming sheet 42 in a reciprocating motion in the main scan direction X. Moving from one side to the other on the reciprocating carriage 33, the printhead 34 selectively activates the nozzles according to image data to eject ink droplets across the sheet 42 while the transport belt 51 is at rest. When one swath of ink image is created, the transport belt 51 advances the sheet 42 by a given amount and stops. The printhead 34 then forms another swath of ink image in a succeeding portion of the sheet 42 by moving back to the side from which it came. Such a process is repeated until an end signal is transmitted and/or until a trailing end of the sheet 42 reaches the print zone.

When duplex printing is intended, the transport belt 51 rotates in the opposite direction to introduce the recording sheet 42 into the sheet reversing unit 71. The sheet reversing unit 71 turns over the incoming sheet 42 for re-feeding to the entrance nip, and the same process is repeated to print an image on the reverse side of the recording sheet 42.

After printing, the transport belt 51 forwards the recording sheet 42 to the output unit, which strips the incoming sheet 42 from the belt surface with the sheet separator 61 for ejecting it downward to the output tray 3 with the ejection roller 62 and the spur 63. Where required, the maintenance station 81 may perform various maintenance/recovery operations to restore the condition of the nozzles and ensure reliable performance of the printhead 34, for example, by sucking the nozzles clear with the nozzle caps 82*ck* and 82*ym*, wiping the nozzle face with the wiper blade 83, firing the nozzles to discharge dried viscous ink into the first spittoon 84 as the printer idles and into the second spittoon 88 during printing, removing ink residue accumulated on the wiper blade 83, etc.

Figure 3:
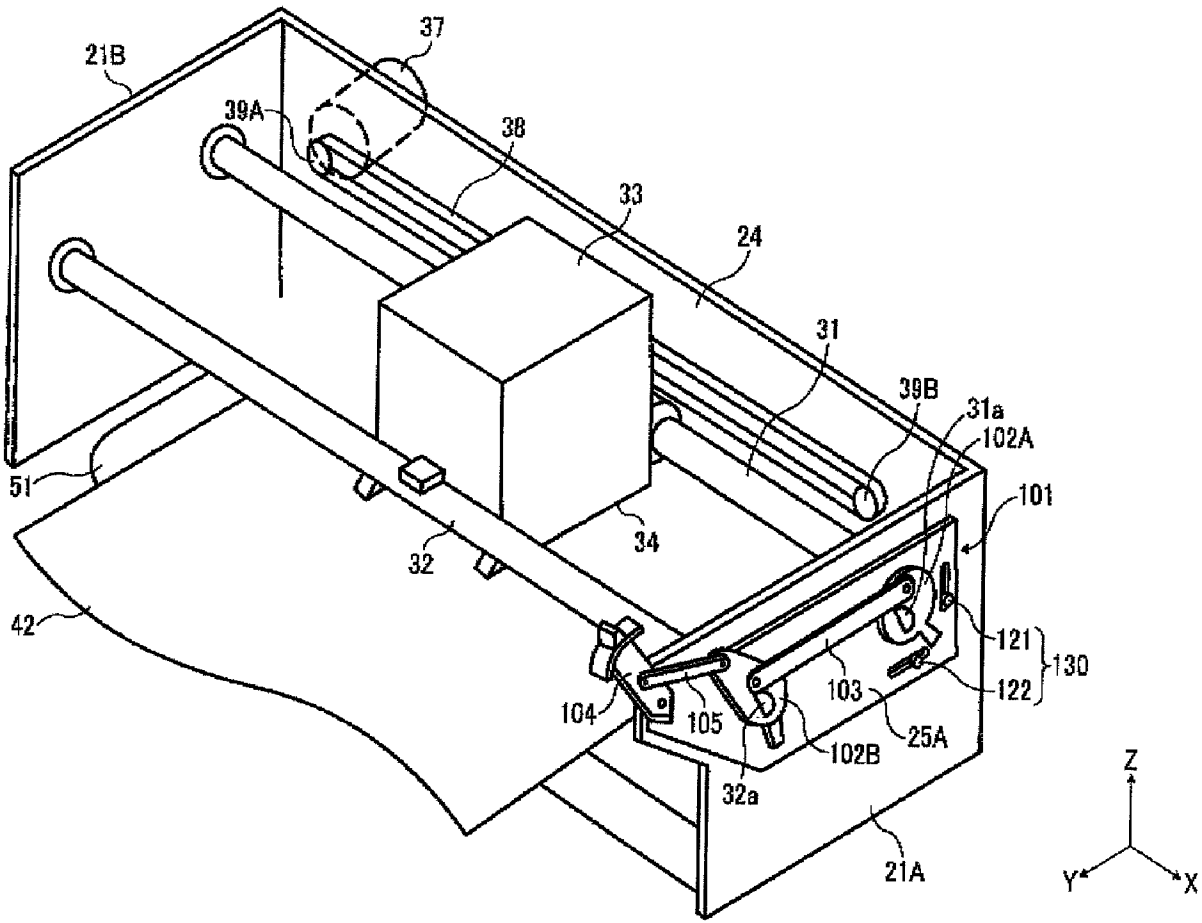
FIG. 3 is a perspective view of a printhead carriage in its operational position within the image forming apparatus of FIG. 1.

FIG. 3 is a perspective view schematically illustrating the printhead carriage 33 in its operational position within the image forming apparatus 1.

As shown in FIG. 3, the printhead carriage 33 is slidably held on the parallel guide rods 31 and 32 each extending between the first and second sidewalls 21A and 21B along a longitudinal axis substantially parallel to the sheet supporting surface of the transport belt 51 on which a recording sheet 42 is placed during printing. The carriage 33 connects to a timing belt 38 trained for rotation around a pair of pulleys 39A and 39B driven by a belt drive motor 37, which are disposed on a rear wall 24 adjoining the first and second sidewalls 21A and 21B of the apparatus body.

During operation, the timing belt 38 together with the motor-driven pulleys 39A and 39B drives the printhead carriage 33 to reciprocate along the guide rods 31 and 32 in the main scan direction X, while the printhead 34 ejects ink toward a recording sheet 42 placed on the sheet supporting surface of the transport belt 51 moving in the sub-scan direction Y.

According to this patent specification, the image forming apparatus 1 incorporates a positioning mechanism 101 that enables positioning of the printhead carriage 33 relative to the sheet supporting surface of the transport belt 51 (i.e., in a vertical direction Z substantially perpendicular to the horizontal directions X and Y), so as to adjust a print gap defined between the nozzle face of the printhead 34 and the sheet supporting surface of the transport belt 51 depending, for example, on the thickness of recording sheet used, or any environmental factor that causes variations in the space between the nozzle face and the sheet surface during printing.

Figure 4:
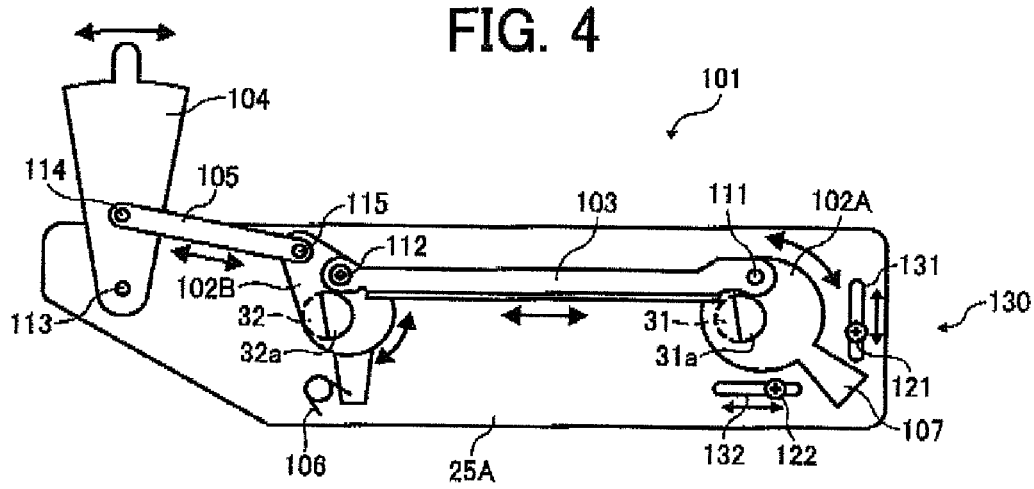
FIG. 4 is a side-elevational view schematically illustrating a positioning mechanism for the printhead carriage according to one embodiment of this patent specification.

With additional reference to FIG. 4, it can be seen that the positioning mechanism 101 includes a pair of first and second rotatable eccentric bearings 102A and 102B, an operating lever 104, and a rotation restrictor 130, all mounted on an adjustment plate 25A adjustably secured to the first sidewall 21A of the apparatus body.

The first and second eccentric bearings 102A and 102B are mounted to adjoining ends 31*a* and 32*a* of the first and second guide rods 31 and 32, respectively, each being rotatable around a rotational axis offset from the longitudinal axis of the corresponding guide rod. The first eccentric bearing 102A has a flange 107 extending outward from its rotational axis along the surface of the adjustment plate 25A. The second eccentric bearing 102B has a spring 106 for securing it in place. The operating lever 104 is hinged to the adjustment plate 21A for rotation around a pivot axis 113, with its free end accessible to an operator after assembly and installation of the positioning mechanism 101.

The first and second bearings 102A and 102B are connected by a first link 103 having opposite ends hinged to the bearings 102A and 102B via swivels 111 and 112, respectively. Similarly, the second bearing 102B and the operating lever 104 are connected with a second link 105 having opposite ends hinged to the lever 104 and the bearing 102B via swivels 114 and 115, respectively. When not in use, the second link 105 may be detached from the swivels 114 and 115 for removal from the lever 104 and the bearing 102B.

The rotation restrictor 130 includes a pair of protrusions 121 and 122 each projecting outward from the surface of the adjustment plate 25A to contact an edge of the bearing flange 107 when the flange 107 is in a particular position with respect to the bearing rotational axis. These protrusions 121 and 122 are accommodated and retained within a pair of elongated vertical and horizontal guide slots 131 and 132, respectively, provided in the adjustment plate 25A around the eccentric bearing 102A. Each of the protrusions 121 and 122 is displaceable with respect to the rotational axis of the eccentric bearing 102A by sliding along the length of the corresponding guide slot.

Although not depicted in the drawing, there is a second adjustment plate 25B on the second sidewall 21B opposite the first sidewall 21A and of generally the same structure as the first adjustment plate 25A. The second adjustment plate 25B has a pair of eccentric bearings to support adjoining ends of the first and second guide rods 31 and 32, respectively, each being rotatable around a rotational axis offset from the longitudinal axis of the corresponding guide rod, but is not provided with a rotation restrictor as is the first adjustment plate 25A, which includes the rotation restrictor 130 as in the embodiment described herein.

To perform print gap adjustment with the positioning mechanism 101, an operator rotates the operating lever 104 around the pivot axis 113. Rotating the lever 104 in one direction causes the second eccentric bearing 102B to rotate in the same direction due to the connection via the swiveled link 105, which in turn causes the first eccentric bearing 102A to rotate in the same direction due to the connection via the swiveled link 103. The eccentric bearings 102A and 102B, thus rotating in tandem by an equal amount, cause the guide rods 31 and 32 to move relative to the sheet supporting surface of the transport belt 51 as they rotate the eccentric bearings on the second adjustment plate 25B.

Specifically, to establish a narrow print gap to accommodate a thin recording sheet, an operator moves the lever 104 counterclockwise to rotate the eccentric bearings 102A and 102B counterclockwise to shift the guide rods 31 and 32 downward. The rotation of the lever 104 ends where the protrusion 121 contacts the flange 107 to restrict further rotation of the first eccentric bearing 102A as well as the second eccentric bearing 102B. This brings the printhead carriage 33 into a first, lowered position relatively close to the sheet supporting surface of the transport belt 51 to define a narrow print gap between the nozzle face and the belt surface.

Contrarily, to establish a wide print gap to accommodate a thick recording sheet, an operator moves the lever 104 clockwise to rotate the eccentric bearings 102A and 102B clockwise to shift the guide rods 31 and 32 upward. The rotation of the lever 104 ends where the protrusion 122 contacts the flange 107 to restrict further rotation of the first eccentric bearing 102A as well as the second eccentric bearing 102B. This brings the printhead carriage 33 into a second, raised position relatively far from the sheet supporting surface of the transport belt 51 to define a wide print gap between the nozzle face and the belt surface.

When the carriage operational position is thus established, the spring 106 is engaged with the second eccentric bearing 102B, thereby holding the whole mechanism 101 in place to complete print gap adjustment.

In such a configuration, the positioning mechanism 101 according to this patent specification enables fine adjustment of the print gap after installation of the carriage assembly, for example, depending on the thickness of recording sheet most frequently used in a specific usage environment.

Specifically, to finely adjust the print gap, the first and second operational positions of the printhead carriage 33 are modifiable by displacing the rotation restricting protrusions 121 and 122 along the respective guide slots 131 and 132 with respect to the rotational axis of the first eccentric bearing 102A. Displacing the protrusion 121 or 122 changes the position at which the bearing flange 107 restricts further rotation of the eccentric bearing 102A, which in turn slightly changes the operational position into which the printhead carriage 33 enters as the bearings 102A and 102B stop rotation.

For example, where a user frequently uses a specific type of recording sheet thinner than those which the image forming apparatus 1 is designed to accommodate, the first operational position of the carriage 33 is modified by displacing the protrusion 121 upward along the guide slot 131 from the position initially specified. This causes the eccentric bearings 102A to rotate far enough counterclockwise as the operating lever 104 is rotated counterclockwise, so as to bring the carriage 33 into a position lower than the original first position when the flange 107 contacts the protrusion 121, thus establishing a sufficiently narrow print gap to accommodate the special thin recording sheet.

Similarly, where a user frequently uses a specific type of recording sheet thicker than those which the image forming apparatus 1 is designed to accommodate, the second operational position of the carriage 33 is modified by displacing the protrusion 122 leftward along the guide slot 132 from the position initially specified. This causes the eccentric bearings 102A to rotate far enough clockwise as the operating lever 104 is rotated clockwise, so as to bring the carriage 33 into a position higher than the original second position when the flange 107 contacts the protrusion 122, thus establishing a sufficiently wide print gap to accommodate the special thick recording sheet.

The fine adjustment described above may be readily performed during installation of the carriage 33 to adapt it for a specific application contemplated, or after installation of the carriage 33 by a service engineer to tune it according to the actual usage environment of the image forming apparatus 1.

In addition to enabling fine adjustment of the print gap, the positioning mechanism 101 according to this patent specification facilitates initial setup of the print gap during assembly of the printhead carriage 33, based on the combined use of the adjustment plates 25 and the displaceable rotation restricting protrusions 121 and 122 providing dual-stage adjustment to the print gap.

Specifically, a first adjustment stage occurs when the adjustment plates 25A and 25B are mounted on the opposed sidewalls 21A and 21B of the apparatus body so as to align the nozzle face of the printhead 34 in parallel with, and at a given sufficient distance from, the sheet supporting surface of the transport belt 51. The first adjustment stage is followed by a second adjustment stage in which the first and second operational positions of the carriage 33 are established by locating the protrusions 121 and 122 at appropriate positions within the respective guide slots 131 and 132 in the manner described above.

Thus, the first adjustment stage provides coarse adjustment of the print gap so as to compensate for manufacturing tolerances of the individual components, whereas the second adjustment stage provides precise adjustment of the printhead position to obtain desired print gaps for two standard types of recording sheets used in the image forming apparatus 1. Note that, with the arrangement described herein, the parallelism between the nozzle face and the sheet supporting surface which is established through the first adjustment stage is maintained throughout the second adjustment stage, since the relative positions of the guide rods 31 and 32 held by the eccentric bearings 31*a* and 32*b* linked in tandem will not change once the adjustment plates 21A and 21B are fixed in place.

Such dual-stage adjustment is simple and efficient compared to a conventional configuration where both precise parallelism and adequate spacing between the nozzle face and the sheet supporting surface are simultaneously established using special tools, leading to fast and accurate assembly of the printhead carriage 33 through the positioning mechanism 101 according to this patent specification.

Figure 5:
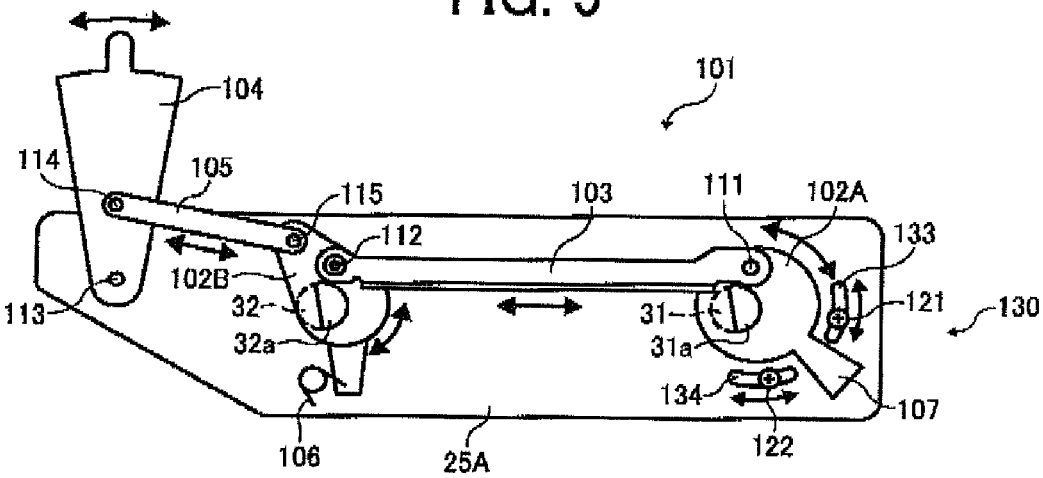
FIG. 5 is a side-elevational view schematically illustrating the positioning mechanism according to another embodiment of this patent specification.

FIG. 5 is a side-elevational view schematically illustrating the positioning mechanism 101 according to another embodiment of this patent specification.

As shown in FIG. 5, the present embodiment is similar to that depicted in FIG. 4, except that the rotation restrictor 130 has a pair of curved guide slots 133 and 134, instead of the straight guide slots 131 and 132, for accommodating the displaceable protrusions 121 and 122, respectively.

Specifically, the curved guide slots 133 and 134 are concentrically defined in the adjustment plate 25A around the rotational axis of the first eccentric bearing 102A, so that the protrusions 121 and 122, when displaced, move in a circle around the bearing rotational axis by sliding along the respective guide slots 133 and 134.

Such a configuration allows the flange 107 to have definite points to strike the rotation restricting protrusions 121 and 122 positioned along the same circle around the bearing rotational axis. This eliminates the need for machining the flange 107 with high precision over the entire length of each edge, leading to efficient quality control and reduced manufacturing cost of the positioning mechanism 101.

Figure 6:
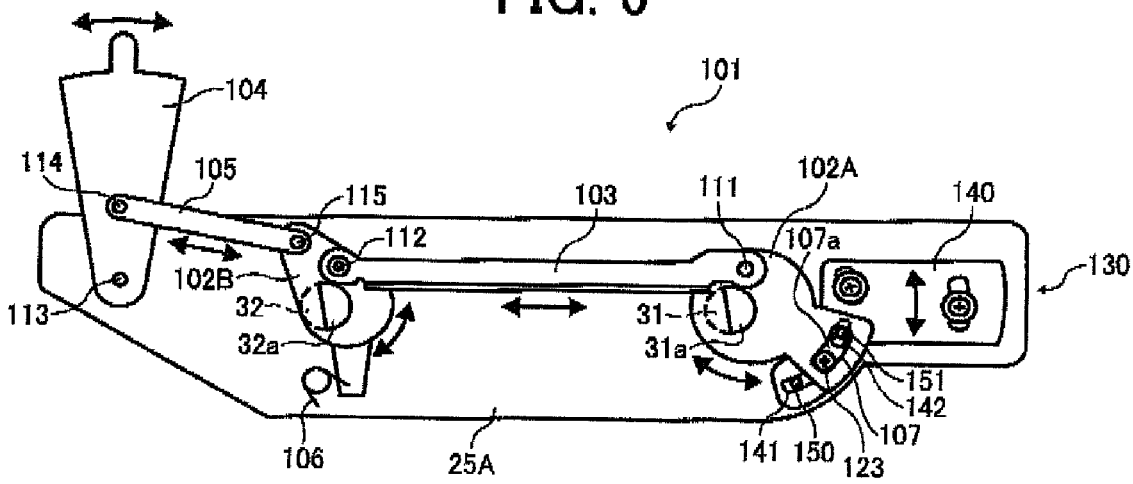
FIG. 6 is a side-elevational view schematically illustrating the positioning mechanism according to still another embodiment of this patent specification.

FIG. 6 is a side-elevational view schematically illustrating the positioning mechanism 101 according to still another embodiment of this patent specification.

As shown in FIG. 6, the present embodiment is similar to that depicted in FIG. 4, except that the rotation restrictor 130 includes a single protrusion 123 fixed on an intermediate adjustment plate 140 displaceably mounted on the adjustment plate 25A, instead of the pair of protrusions 121 and 122 displaceably disposed within the guide slots 131 and 132 defined in the adjustment plat 25A.

Specifically, the protrusion 123 projects outward from the surface of the intermediate adjustment plate 140 and is accommodated and retained in a slot 107*a* defined in the bearing flange 107, with its opposite edges each contacting the adjoining edge of the flange slot 107*a* when the flange 107 is in a particular position with respect to the rotational axis of the first eccentric bearing 102A.

The intermediate adjustment plate 140 is mounted on the adjustment plate 25A by engaging a pair of protrusions 150 and 151 of the adjustment plate 25A in a pair of curved guide slots 141 and 142 defined in the intermediate adjustment plate 140. The protrusions 150 and 151 are disposed concentrically around the rotational axis of the first eccentric bearing 102A, so that the intermediate adjustment plate 140 rotates around the bearing rotational axis by sliding the protrusions 150 and 151 along its guide slots 140 and 141.

In such a configuration, the positioning mechanism 101 positions the printhead carriage 33 in a manner similar to that depicted with reference to FIGS. 3 and 4, wherein the carriage 33 is set in the first operational position when the lower edge of the protrusion 123 contacts the adjoining edge of the flange slot 107*a*, and in the second operational position when the upper edge of the protrusion 123 contacts the adjoining edge of the flange slot 107*a*. Moreover, fine adjustment of the print gap is performed by modifying the first and second operational positions of the carriage 33, wherein the intermediate adjustment plate 140 is displaced or rotated around the rotational axis of the first eccentric bearing 102A so as to change the positions in which the bearing flange 107 contacts the respective edges of the protrusion 123.

Thus, the embodiment depicted in FIG. 6 provides ready positioning of the printhead carriage 33 as well as fine adjustment of the print gap through the positioning mechanism 101. Further, owing to the combined use of the adjustment plates 25 and the displaceable rotation restricting protrusion 123, this embodiment also provides dual-stage adjustment that enables accurate and fast positioning of the printhead carriage 33 through the positioning mechanism 101 as in the embodiment depicted earlier.

Figure 7:
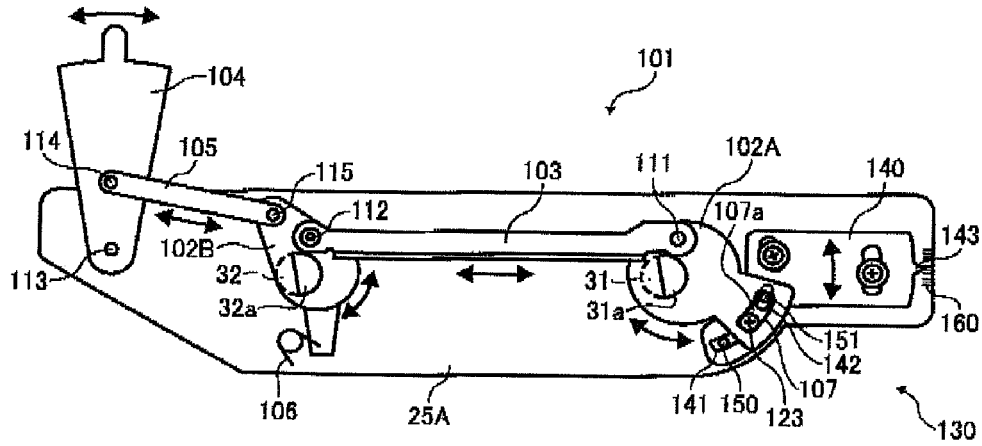
FIG. 7 is a side-elevational view schematically illustrating the positioning mechanism according to still another embodiment of this patent specification.

FIG. 7 is a side-elevational view schematically illustrating the positioning mechanism 101 according to still another embodiment of this patent specification.

As shown in FIG. 7, the present embodiment is similar to that depicted in FIG. 6, except that the positioning mechanism 101 has a scale 160 provided on the adjustment plate 25A to indicate an amount by which the intermediate adjustment plate 140 is displaced relative to the adjustment plate 25A.

Specifically, the scale 160 defines a series of graduations along the edge of the adjustment plate 25A to be read against a pointer or notch 143 disposed on the adjoining edge of the intermediate adjustment plate 140. Based on a change in the reading of the scale 160, an operator can visually confirm the amount by which the intermediate adjustment plate 140 is displaced relative to the adjustment plate 25A, which is substantially proportional to an amount by which the carriage operational position is modified from that initially specified.

Figure 8:
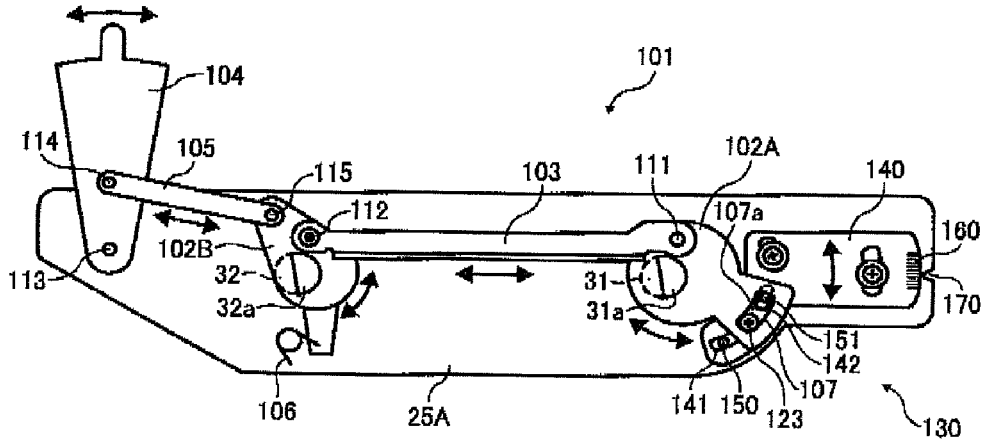
FIG. 8 is a side-elevational view schematically illustrating the positioning mechanism according to yet still another embodiment of this patent specification.

Alternatively, as shown in FIG. 8, the scale 160 may be provided on the edge of the intermediate adjustment plate 140 for reading against a pointer or notch 170 provided on the adjoining edge of the adjustment plate 25A. Still alternatively, one or more graduations may be marked on the edge of the adjustment plate 25A or the intermediate adjustment plate 140 instead of a pointing notch or protrusion for reading the scale on the adjoining edge.

The embodiments depicted with reference to FIGS. 7 and 8 facilitate fine adjustment of the carriage position and the print gap by allowing an operator to visually confirm the displacement of the intermediate adjustment plate 140 relative to the adjustment plate 25A through the scale 160, leading to increased operability of the positioning mechanism 101.

Thus, the image forming apparatus 1 according to this patent specification incorporates the positioning mechanism 101 that uses the rotatable eccentric bearings 102A and 102B to move the guide rods 31 and 32 supporting the printhead carriage 33 relative to the sheet supporting plane of the transport belt 51. In the positioning mechanism 101, the rotation restrictor 130 defines a first point of contact with the bearing flange 107 when the carriage 33 is in the first operational position relatively close to the sheet supporting surface, and a second point of contact with the bearing flange 107 when the carriage 33 is in the second operational position relatively far from the sheet supporting surface. The positioning mechanism 101 provides fine adjustment of the print gap, in which at least one of the operational positions of the carriage 33 is modified by displacing the rotation restrictor 130 with respect to the rotational axis of the eccentric bearing.

Although the embodiments above describe the image forming apparatus as a simple inkjet printer, the positioning mechanism 101 according to this patent specification is applicable to any image forming apparatus that employs an inkjet printhead to produce an image or pattern by ejecting liquid material in droplets, such as a facsimile, photocopier, or multifunctional machine incorporating several of those imaging functions, and to any system employing inkjet printing technology, such as a dispenser used to deposit photoresist for photolithography or DNA samples for genome analysis, etc.

Numerous additional modifications and variations are possible in light of the above teachings. It is therefore to be understood that, within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus, comprising:

a printhead to print an image on a recording medium placed on a substantially horizontal supporting plane;

a carriage on which the printhead is mounted;

one or more guide members, each extending along a longitudinal axis substantially parallel to the supporting plane, to support the carriage with the printhead substantially parallel to the supporting plane; and a positioning mechanism provided on a frame of the image forming apparatus to enable positioning of the carriage relative to the supporting plane, the mechanism including:

an eccentric bearing connected to each guide member and rotatable around a rotational axis offset from the guide member longitudinal axis to move the guide member relative to the supporting plane; and a rotation restrictor to restrict rotation of the eccentric bearing, the rotation restrictor defining a first point of contact with the eccentric bearing that puts the carriage in a first operational position relatively close to the supporting plane, and a second point of contact with the eccentric bearing that puts the carriage in a second operational position relatively far from the supporting plane, the first and second points of contact being displaceable with respect to the bearing rotational axis to modify the first and second operational positions of the carriage, wherein the rotation restrictor comprises a protrusion to contact the eccentric bearing to restrict rotation of the eccentric bearing, the protrusion being displaceable with respect to the rotational axis of the eccentric bearing to modify the first and second operational positions of the carriage, and wherein the displaceable protrusion moves concentrically around the rotational axis of the eccentric bearing.

2. The image forming apparatus according to claim 1, wherein the positioning mechanism includes multiple eccentric hearings, the positioning mechanism further including a link to connect the multiple eccentric bearings to each other to rotate in tandem around the respective rotational axes.

3. The image forming apparatus according to claim 1, wherein the rotation restrictor comprises a single protrusion with opposed edges each to contact the eccentric bearing to restrict rotation of the eccentric bearing, the protrusion being fixed on an intermediate plate displaceable with respect to the bearing rotational axis to modify the operational positions of the carriage.

4. The image forming apparatus according to claim 3, wherein the displaceable intermediate plate moves concentrically around the rotational axis of the eccentric bearing.

5. The image forming apparatus according to claim 1, wherein the positioning mechanism further includes a scale to indicate an amount by which the carriage operational position is modified.

6. The image forming apparatus according to claim 1, further comprising an adjustment plate adjustably secured to a frame of the image forming apparatus, wherein the positioning mechanism is mounted on the adjustment plate.

7. An image forming apparatus, comprising:

a printhead to print an image on a recording medium placed on a substantially horizontal supporting plane;

a carriage on which the printhead is mounted;

one or more guide members, each extending along a longitudinal axis substantially parallel to the supporting plane, to support the carriage with the printhead substantially parallel to the supporting plane;

an eccentric bearing connected to each guide member and rotatable around a rotational axis offset from the guide member longitudinal axis to move the guide member relative to the supporting plane;

means for causing the one or more eccentric bearings to rotate in tandem around the respective rotational axes;

means for restricting rotation of the eccentric bearing to position the carriage either in a first operational position relatively close to the supporting plane, or n a second operational position relatively far from the supporting plane; and means for modifying the operational positions of the carriage, wherein the means for restricting the rotation of the eccentric hearing comprises a protrusion to contact the eccentric bearing to estrict the rotation of the eccentric bearing, the protrusion being displaceable with respect to the rotational axis of the eccentric bearing to modify the first and second operational positions of the carriage, and wherein the displaceable protrusion moves concentrically around the rotational axis of the eccentric bearing.

* * * * *